US007726386B2

(12) United States Patent
Specht

(10) Patent No.: US 7,726,386 B2
(45) Date of Patent: Jun. 1, 2010

(54) BURNER PORT SHIELD

(75) Inventor: Werner O. Specht, Hermitage, PA (US)

(73) Assignee: Thomas & Betts International, Inc., Wilmington, DE (US)

( * ) Notice: Subject to any disclaimer, the term of this patent is extended or adjusted under 35 U.S.C. 154(b) by 1002 days.

(21) Appl. No.: 11/329,960

(22) Filed: Jan. 11, 2006

(65) Prior Publication Data

US 2006/0157232 A1 Jul. 20, 2006

Related U.S. Application Data

(60) Provisional application No. 60/644,161, filed on Jan. 14, 2005, provisional application No. 60/670,742, filed on Apr. 13, 2005.

(51) Int. Cl.
*F28F 19/00* (2006.01)
*F24H 3/00* (2006.01)

(52) U.S. Cl. ..... 165/134.1; 165/178

(58) Field of Classification Search ..... 165/173, 165/178, 134.1, 71; 126/99, 99 R, 110 R, 126/106; 431/330, 354
See application file for complete search history.

(56) References Cited

U.S. PATENT DOCUMENTS

| | | | |
|---|---|---|---|
| 1,135,840 | A | 4/1915 | Oudeville |
| 1,328,589 | A | 1/1920 | Roberts |
| 1,372,724 | A | 3/1921 | Stine |
| 1,408,631 | A | 3/1922 | Para |
| 1,500,513 | A | 7/1924 | Merrill |
| 1,568,771 | A | 1/1926 | Roy |
| 1,604,783 | A | 10/1926 | Pickup |
| 1,641,350 | A | 9/1927 | Nieberding |
| 1,671,938 | A | 5/1928 | Sinclair |
| 1,744,439 | A | 1/1930 | Bitgood |
| 1,754,857 | A | 4/1930 | Harrison |
| 1,789,226 | A | 1/1931 | Ensign et al. |
| 1,830,464 | A | 11/1931 | Guenther |
| 1,870,013 | A | 8/1932 | Keenan, Jr. |
| 1,910,020 | A | 5/1933 | Le Boutillier et al. |
| 1,987,372 | A | 1/1935 | Schellhammer |
| 1,995,934 | A | 3/1935 | Mangold |
| 2,210,069 | A | 8/1940 | Ensign |
| 2,242,176 | A | 5/1941 | Denise |

(Continued)

FOREIGN PATENT DOCUMENTS

| | | |
|---|---|---|
| DE | 4223513 | 1/1994 |

(Continued)

*Primary Examiner*—Tho v Duong
(74) *Attorney, Agent, or Firm*—Hoffmann & Baron, LLP

(57) ABSTRACT

A shield for placement around burner ports in a hot air furnace for reducing turbulence in the flow of secondary combustion air entering a heat exchanger. The shield also provides for intercepting moisture that condenses along the walls of the vertically oriented heat exchanger. The heat exchanger is part of a furnace. The drip shield includes a plate having a longitudinal axis and a plurality of through-openings placed in the plate along and/or parallel to its longitudinal axis. The through-openings are spaced apart so as to be positioned between and aligned with burner ports and respective heat exchanger tube inlets of the heat exchanger. The plate is preferably profiled to have a peak to encourage condensate run-off with the plurality of through-openings being placed along or generally parallel to the peak of the plate.

5 Claims, 14 Drawing Sheets

U.S. PATENT DOCUMENTS

| | | | | | |
|---|---|---|---|---|---|
| 2,251,710 | A | | 8/1941 | Livar | |
| 2,300,560 | A | | 11/1942 | Faber | |
| 2,333,602 | A | | 11/1943 | Van Almelo | |
| 2,424,792 | A | | 7/1947 | Blum | |
| 2,480,547 | A | | 8/1949 | Caracristi | |
| 2,525,350 | A | | 10/1950 | Hanson | |
| 2,590,866 | A | | 4/1952 | Jost et al. | |
| 2,598,474 | A | | 5/1952 | Weaver | |
| 2,607,405 | A | | 8/1952 | Weinandy | |
| 2,611,359 | A | | 9/1952 | Scogin | |
| 2,625,992 | A | | 1/1953 | Beck | |
| 2,655,143 | A | | 10/1953 | Herbster | |
| 2,751,900 | A | | 6/1956 | Modine | |
| 2,791,997 | A | | 5/1957 | Monkowski | |
| 2,815,069 | A | | 12/1957 | Garraway | |
| 2,960,983 | A | | 11/1960 | Goss | |
| 3,040,805 | A | | 6/1962 | Lambert | |
| 3,047,056 | A | | 7/1962 | Flynn | |
| 3,057,400 | A | | 10/1962 | Wagner | |
| 3,144,901 | A | | 8/1964 | Meek | |
| 3,198,492 | A | | 8/1965 | Schneider | |
| 3,241,544 | A | | 3/1966 | Lohman | |
| 3,352,573 | A | | 11/1967 | Canning | |
| 3,411,716 | A | | 11/1968 | Stephan et al. | |
| 3,527,290 | A | | 9/1970 | Lossing | |
| 3,552,378 | A | | 1/1971 | Zavadsky et al. | |
| 3,617,159 | A | | 11/1971 | Arndt | |
| 3,628,735 | A | | 12/1971 | Desty et al. | |
| 3,638,635 | A | | 2/1972 | Drennan | |
| 3,670,713 | A | | 6/1972 | Abbott | |
| 3,694,137 | A | | 9/1972 | Fichter | |
| 3,861,419 | A | | 1/1975 | Johnson | |
| 3,935,855 | A | | 2/1976 | Van Vliet | |
| 3,944,142 | A | | 3/1976 | Welden et al. | |
| 3,960,393 | A | | 6/1976 | Hosokawa et al. | |
| 3,974,022 | A | | 8/1976 | Lauro | |
| 3,990,262 | A | | 11/1976 | Griffin | |
| 4,050,632 | A | | 9/1977 | Wyse | |
| 4,087,050 | A | | 5/1978 | Tsuji et al. | |
| 4,163,441 | A | | 8/1979 | Chen | |
| 4,253,403 | A | | 3/1981 | Vatsky | |
| 4,305,372 | A | | 12/1981 | Hahn | |
| 4,319,125 | A | | 3/1982 | Prince | |
| 4,340,355 | A | | 7/1982 | Nelson et al. | |
| 4,348,170 | A | | 9/1982 | Vatsky et al. | |
| 4,384,178 | A | | 5/1983 | Nagai et al. | |
| 4,400,151 | A | | 8/1983 | Vatsky | |
| 4,436,059 | A | | 3/1984 | Galati | |
| 4,467,780 | A | | 8/1984 | Ripka | |
| 4,546,820 | A | | 10/1985 | Whipple | |
| 4,553,925 | A | | 11/1985 | Bricmont | |
| 4,603,680 | A | * | 8/1986 | Dempsey et al. | 126/99 A |
| 4,649,894 | A | * | 3/1987 | Hoeffken | 126/119 |
| 4,896,411 | A | * | 1/1990 | Dempsey | 29/890.039 |
| 4,909,728 | A | | 3/1990 | Nakamoto et al. | |
| 4,945,890 | A | | 8/1990 | Ripka | |
| 5,011,400 | A | | 4/1991 | Vatsky | |
| 5,060,722 | A | * | 10/1991 | Zdenek et al. | 165/170 |
| 5,094,224 | A | * | 3/1992 | Diesch | 126/110 R |
| 5,174,366 | A | | 12/1992 | Nagakura et al. | |
| 5,301,654 | A | * | 4/1994 | Weber et al. | 126/110 R |
| 5,342,097 | A | | 8/1994 | Hanson | |
| 5,346,002 | A | * | 9/1994 | Swilik et al. | 165/173 |
| 5,347,937 | A | | 9/1994 | Vatsky | |
| 5,361,751 | A | | 11/1994 | Biggs et al. | |
| 5,368,476 | A | | 11/1994 | Sugahara et al. | |
| 5,370,175 | A | | 12/1994 | Waterman et al. | |
| 5,375,586 | A | | 12/1994 | Schumacher et al. | |
| 5,408,943 | A | | 4/1995 | Vatsky | |
| 5,437,263 | A | | 8/1995 | Ellingham et al. | |
| 5,448,986 | A | | 9/1995 | Christopher et al. | |
| 5,460,415 | A | | 10/1995 | Lengauer et al. | |
| 5,470,018 | A | | 11/1995 | Smith | |
| 5,492,167 | A | | 2/1996 | Glesmann | |
| 5,568,777 | A | | 10/1996 | Breen et al. | |
| 5,582,159 | A | | 12/1996 | Harvey et al. | |
| 5,601,071 | A | | 2/1997 | Carr et al. | |
| 5,626,125 | A | | 5/1997 | Eaves | |
| 5,685,695 | A | | 11/1997 | Klement et al. | |
| 5,724,897 | A | | 3/1998 | Breen et al. | |
| 5,735,085 | A | | 4/1998 | Denooy | |
| 5,795,145 | A | | 8/1998 | Manning et al. | |
| 5,997,285 | A | * | 12/1999 | Carbone et al. | 431/354 |
| 6,027,336 | A | | 2/2000 | Nolte et al. | |
| 6,036,481 | A | | 3/2000 | Legutko et al. | |
| 6,062,848 | A | | 5/2000 | Lifshits | |
| 6,109,255 | A | | 8/2000 | Dieckmann et al. | |
| 6,179,212 | B1 | | 1/2001 | Banko | |
| 6,179,608 | B1 | | 1/2001 | Kraemer et al. | |
| 6,196,835 | B1 | | 3/2001 | Gutmark et al. | |
| 6,866,202 | B2 | | 3/2005 | Sigafus et al. | |
| 6,889,686 | B2 | | 5/2005 | Specht | |
| 2002/0155404 | A1 | | 10/2002 | Casey et al. | |

FOREIGN PATENT DOCUMENTS

| | | |
|---|---|---|
| EP | 0781966 | 7/1997 |
| EP | 0930473 | 7/1999 |
| JP | 61-231351 | 10/1986 |
| JP | 03-67918 | 3/1991 |
| JP | 04-6314 | 1/1992 |
| JP | 06-288535 | 10/1994 |
| JP | 07-49117 | 2/1995 |
| JP | 07-198130 | 8/1995 |
| JP | 08-86416 | 4/1996 |
| JP | 08-226616 | 9/1996 |
| JP | 08-291913 | 11/1996 |
| JP | 08 200818 | 12/1996 |
| JP | 09-96442 | 4/1997 |
| JP | 10-38375 | 2/1998 |
| JP | 2002-005437 | 1/2002 |
| JP | 2002-71213 | 3/2002 |
| JP | 2003-65507 | 3/2003 |
| WO | WO 95/09285 | 4/1995 |
| WO | WO 00/73711 | 12/2000 |

* cited by examiner

BURNER PORT SHIELD

CROSS-REFERENCE TO RELATED APPLICATIONS

This application claims priority to U.S. Provisional Application No. 60/644,161, filed Jan. 14, 2005, and U.S. Provisional Application No. 60/670,742, filed Apr. 13, 2005.

FIELD OF THE INVENTION

The present invention generally relates to the field of heating, ventilation and air conditioning systems. More specifically, the present invention pertains to a protective shield around burner ports in a hot air furnace.

BACKGROUND OF THE INVENTION

Heating, ventilation and air conditioning systems are commonly used in both residential and commercial environments to control indoor air temperature. In geographical areas experiencing cold or humid conditions, the circulation of heated air through air ducts and into a home or office provides comfort and improves occupants' health.

In order to heat air to be circulated into an indoor environment, many heating systems utilize gas-fired hot air furnaces. Gas-fired furnaces typically include a heat exchanger made up of a plurality of heat exchanger tubes. Each of the tubes defines an internal flow path through which hot combustion gases are circulated. The walls of the heat exchanger tubes are thereby warmed through conduction. Air is then forced externally over the outer walls of the heat exchanger tubes whereupon the air is warmed and circulated into the indoor environment.

In order to produce the hot combustion gases, a fuel-gas is fed through a manifold in the furnace. The manifold has a plurality of outlets corresponding with the number of heat exchanger tubes employed. Interposed between the heat exchanger tubes and the manifold outlets are a plurality of burners. The burners are provided in one-to-one correspondence to the number of heat exchanger tubes. The burners may be of conventional construction such as the type shown in U.S. Pat. No. 6,196,835.

In operation, the air/fuel-gas mixture is pulled across the burners and into the associated heat exchanger tubes at an inlet end. Each burner typically includes an opening defining a venturi device that provides for the proper mixture of air and fuel-gas. The air and fuel-gas are received and combined at one end of the burner adjacent the manifold, and the air/fuel-gas mixture is ignited at the opposite end of the burner at a burner port.

As a part of the injection process, additional air is drawn into the heat exchanger so that the fuel-gas may be fully combusted within the heat exchanger. An induction draft fan is placed at an opposing outlet end of the heat exchanger in order to create negative pressure relative to the burner ports. The induction draft fan may be a single fan that is manifolded to the various heat exchanger tubes by a header so that negative pressure is applied to each heat exchanger tube by a single fan. The application of negative pressure by the fan causes the ignited air/fuel-gas mixture to flow into and through the respective heat exchanger tubes. The fan also produces a positive exhaust pressure to discharge the heated gases from the heat exchanger to a discharge flue.

The tubular heat exchangers are commonly arranged in a serpentine pattern to increase surface area. At the same time, the tubular bodies are spaced-apart to allow external air to flow therebetween. In operation, a blower is provided as part of the heating system. The fan pulls (or pushes) cold room air from the area that is to be heated, and forces that air across the outer surfaces of the heat exchanger surfaces. The air is then pumped through air ducts and into the rooms to be heated.

Referring to FIGS. 1 and 2, typically mechanically exhausted heat exchangers of the clam shell or tubular variety have a heat exchanger inlet end attached to a header. With clam shell heat exchangers such as shown in FIG. 1, the header forms a swaged collar with the end of the heat exchanger (FIG. 1). In the tubular variety, the heat exchanger end is crimped or formed to tightly engage through an opening in the header (FIG. 2). These various steps of swaging and forming cause an irregular surface at the entrance to the heat exchanger inlet. As shown in FIGS. 1 and 2, the irregular surface causes turbulence specifically with regard to entry of secondary combustion air into the primary air/gas mixture. The secondary combustion air is shown by solid arrows and the flame is shown by dotted arrows in FIGS. 1 and 2. Thus, partial products of combustion are created in the early stages of the combustion process due to this turbulent secondary air. Furthermore, the turbulence has a deleterious effect on the combustion process resulting in creation of carbon monoxide and nitrous oxide compounds. Both carbon monoxide and nitrous oxide compounds are undesirable by-products of the combustion process and various industry standards exist which limit the levels of these products. It is contemplated that a less turbulent flow of secondary combustion air when mixing with the primary air gas mixture as the flame enters the heat exchanger will reduce the quantity of carbon monoxide and nitrous oxide compounds produced.

There is therefore a need for an apparatus which will result in a less turbulent flow of secondary combustion air when mixing with the primary air gas mixture upon entry into the heat exchanger.

During periods of cold weather, the hot air furnace operates with some degree of frequency to warm the indoor environment. This has the effect of keeping heated combustion gases moving through and drying the interior combustion chamber walls of the heat exchanger. However, during periods of warmer weather, particularly during the summer months, the furnace may not operate for an extended period of time. This permits warm, high-humidity air to enter the inlets of the heat exchanger tubes. Those of ordinary skill in the art will understand that the interior portion of the heat exchanger of separated combustion units will oftentimes contain outdoor air independent of whether the heater is installed indoors or outdoors. During periods of warm weather when the HVAC system operates in a cooling mode, cooled air is drawn across the combustion chamber walls. This cooled air is usually at a temperature that is below the outdoor air temperature and more importantly below the temperature of air that is inside of the heat exchanger. The result is that high-humidity outdoor air that is inside the heat exchanger condenses and forms droplets of moisture, or "condensates," on the interior walls. The condensates flow down the walls of the tubular heat exchangers and may drip in and around the burner ports of the hot air furnace. The burner ports are primarily fabricated from alloys of metal, and are subject to corrosion when exposed to condensates for extended periods of time. In many instances, burner ports must be replaced prematurely before cooler weather returns to the area and the HVAC system is placed in a heating mode.

There is, therefore, a need for an apparatus that will prevent condensates from collecting around burner ports. There is further a need for a plate that may be positioned above burner ports to intercept condensation before it hits the burner ports and divert the condensation out of the furnace.

SUMMARY OF THE INVENTION

An apparatus provided which is attachable to the entry portion of a heat exchanger which results in less turbulent flow of secondary combustion air entering the heat exchanger so that, when mixing with the primary air and fuel-gas mixture, the quantity of carbon monoxide and nitrous oxide compounds are reduced.

An apparatus is provided herein by which condensation dripping from the walls of a heat exchanger of a furnace may be substantially intercepted before landing around burner ports. The apparatus defines a burner port drip shield that is sized to be positioned between the burner ports and the heat exchanger. In one aspect, the burner port drip shield represents an elongated plate having a plurality of spaced-apart openings therein. The openings are configured to be aligned between the burner ports and inlets of respective heat exchanger tubes. At the same time, the openings of the drip shield are sized to allow the drip shield to intercept condensates that would otherwise drip off of the tube inlets and onto the burner ports.

Preferably, the top surface of the burner port drip shield is sloped downwardly toward the side having the collection channel. Alternatively, the burner port drip shield could be profiled to have a peak running central or parallel to its longitudinal axis. In either such version, water droplets that land on the shield are urged to run off of the shield towards one or both sides. A collection channel is preferably positioned along each draining side to collect the run-off and deliver water to a collection trough. In addition, the drip shield may have opposing ends and a shoulder positioned along each of the opposing ends. Water may then be delivered into a drain port where it is either collected and retrieved, or diverted away from the furnace.

BRIEF DESCRIPTION OF THE DRAWINGS

So that the manner in which the above recited features of the present invention can be better understood, certain drawings or photographs are appended hereto. It is to be noted, however, that the appended photographs illustrate only selected embodiments of the inventions and are therefore not to be considered limiting of scope, for the inventions admit to other equally effective embodiments and applications.

DETAILED DESCRIPTION OF THE PREFERRED EMBODIMENT

The following definitions will apply to the components described herein.

The term "burner port" is intended to include any burner that may be used to feed combustion gases as part of a hot air furnace.

The term "plate" refers to any thin body fabricated from any material.

The term "drip shield" refers to an apparatus that defines a plate. The drip shield may be of any dimension, and need not be planar or substantially planar.

The term "condensates" refers to any water-based fluid.

Figure 1:
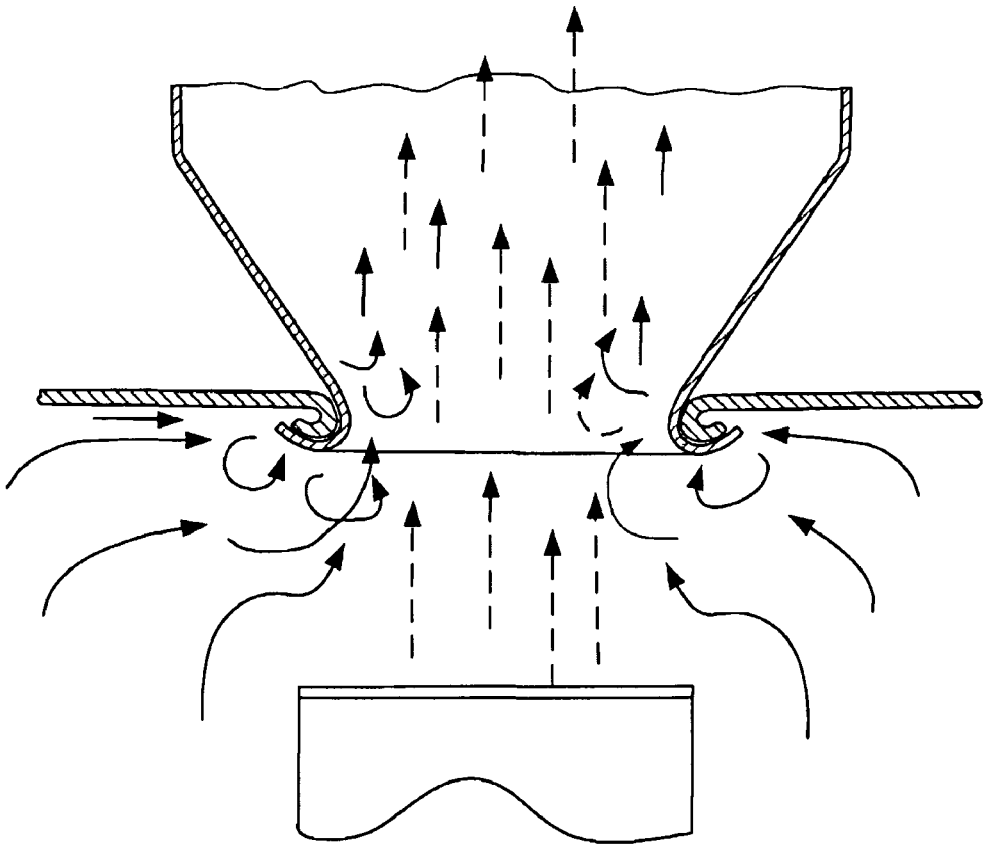
FIG. 1 PRIOR ART
FIGS. 1 and 2 show, in a partial section, prior art representations of a primary air/gas mixture and secondary combustion air entering a clam shell and tubular heat exchanger, respectively.
Figure 2:
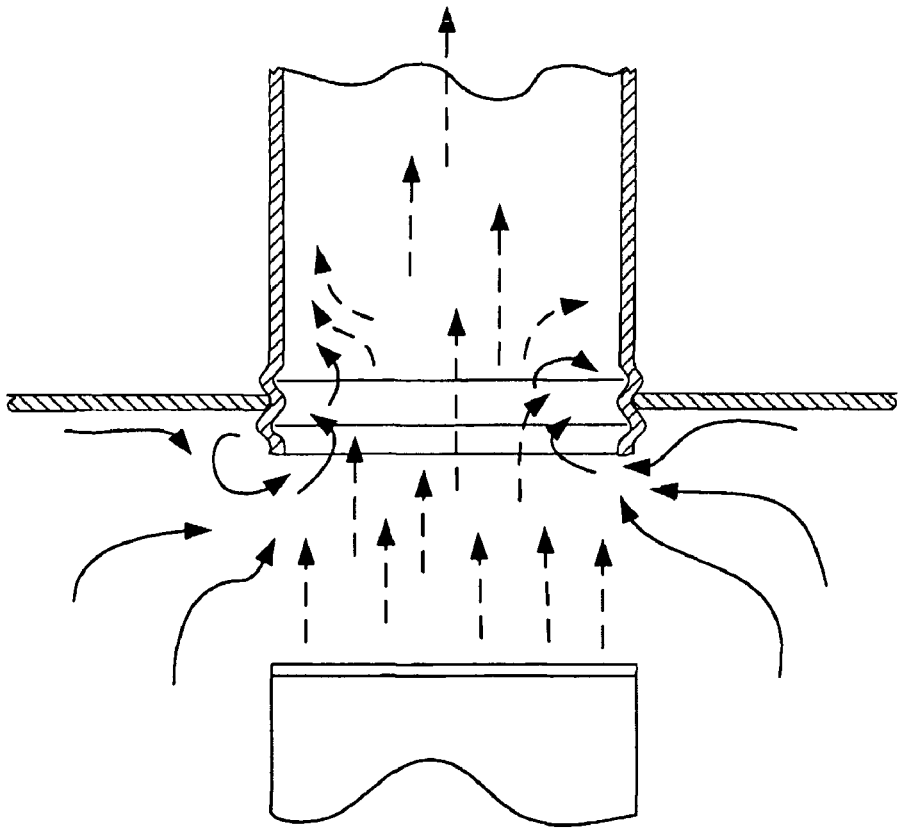
FIG. 2 PRIOR ART
Figure 3:
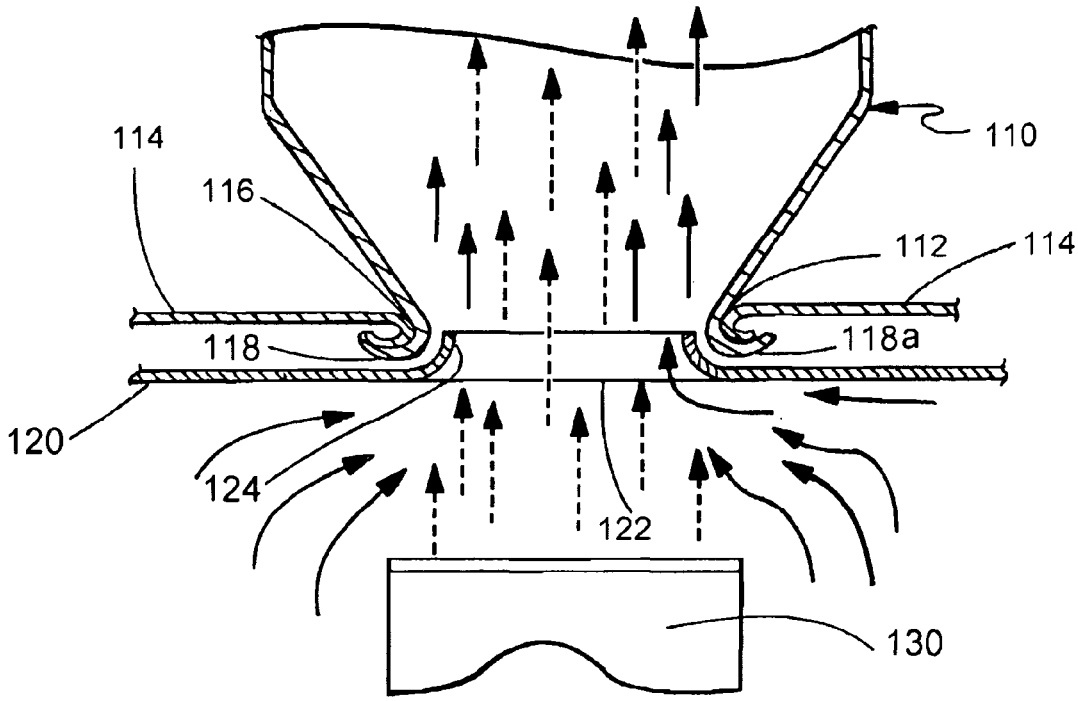
FIGS. 3 and 4 are sectional showings of heat exchangers of FIGS. 1 and 2, respectively, including an improved shield which results in less turbulent entering secondary combustion air.
Figure 4:
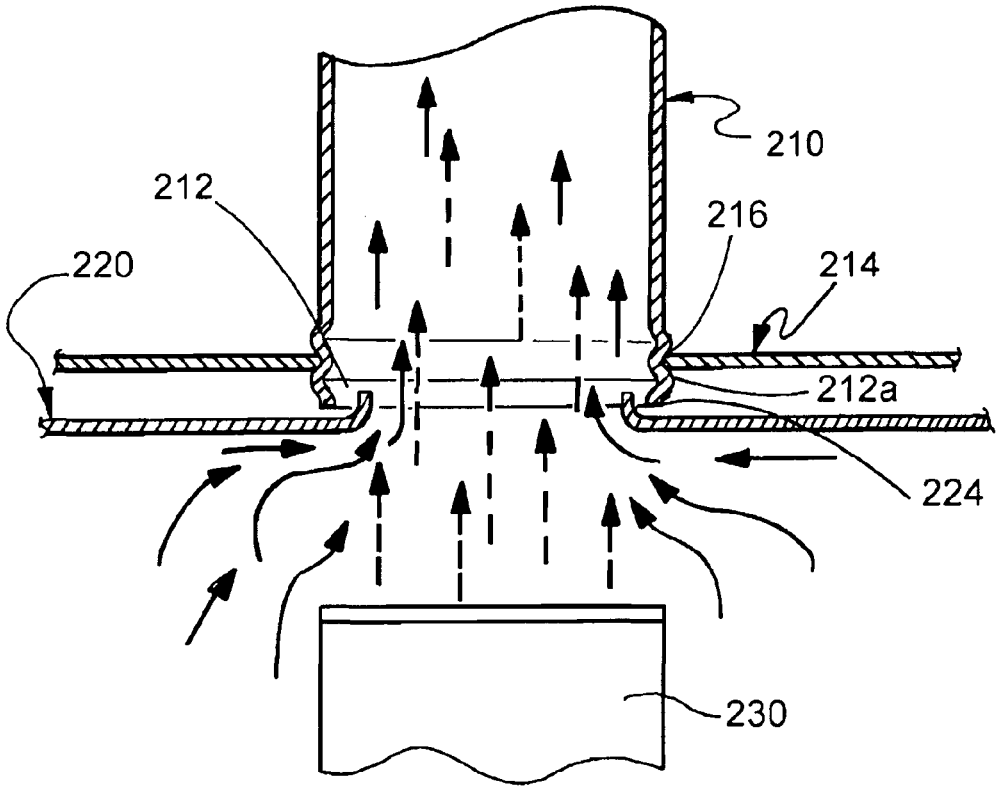

Referring to FIGS. 3 and 4, a shield is provided in combination with heat exchangers where the shield placed at the entry end of the heat exchanger results in less turbulent air flow of secondary combustion air entering the heat exchanger.

Referring specifically to FIG. 3, the entry portion of a clam shell heat exchanger 110 is shown. Clam shell heat exchanger 110 is of conventional construction having a narrow open end 112 at one end thereof. As is known in the art, the end 112 of heat exchanger 110 is secured to a header panel 114 so as to extend through an opening 116 thereof. The heat exchanger end 112 is secured in the opening 116 of the header panel 114 by a rolled crimp 118 uniformly therearound. This rolled crimp forms a lip 118*a*.

In accordance with the present invention, a planar shield 120 is supported adjacent the open end 112 of header 110. Shield 120 is generally a planar member having a central opening 122 which is aligned with the open end 112 of heat exchanger 110. The shield has an annular upwardly extending protrusion 124 forming an annular ring extending towards and preferably slightly into the open end 112 of header 110. The annular protrusion is uniformly and smoothly formed in the shield 120 so that, as shown by the arrows in FIG. 3, the secondary combustion air denoted by the solid arrows smoothly flows through the shield and into the heat exchanger 110. The smooth flow of the secondary combustion air results in laminar flow of the combustion air. Such laminar flow has several benefits. First, laminar flow causes an insulting effect around the walls of the heat exchanger. Thus, combustion products (dotted arrows) produced by burner 130 have a tendency to remain central upon entry, thus passing the combustion products further into the heat exchanger before the combustion products are dispersed.

By reducing entrance turbulence of the secondary combustion air, it has been found that significant reductions of carbon monoxide and nitrous oxide compounds result.

Referring to FIG. 4, a similar arrangement is shown with respect to a tubular heat exchanger. Heat exchanger 210 is of the tubular variety and includes an open end 212 which is formed in a manner to accommodate header panel 214 type relationship therewith. The end of opening 212 defines a lip 212*a* which extends through an opening 216 of panel 214. In a manner similar to the embodiment described above with respect to FIG. 3, a planar shield 220 is supported adjacent the open end 212 of header 210. The shield has an annular upwardly extending protrusion 224 forming an annular ring extending towards and preferably slightly into the open end 212 of shield 210. The annular protrusion is uniformly and smoothly formed in the shield. As shown by the arrows in FIG. 4, the secondary combustion air denoted by the solid arrows flows smoothly through the shield 220 and into the heat exchanger 210. The benefits provided by the shield 220 are similar to those described above with respect to FIG. 3. Thus, the shield 220 shown in FIG. 4 serves the same purposes by maintaining the products of combustion from burner 230 central to the heat exchanger and passing the combustion products further into the heat exchanger before the combustion products is disbursed. This results in significant reductions in carbon monoxide and nitrous oxide compounds being formed.

While the shield of the present invention results in improved performance of the furnace by reducing the turbulence in the entering secondary combustion air and thereby reducing creation of carbon monoxide and nitrous oxide compounds, the shield of the present invention may also provide additional benefits as described below.

Figure 5:
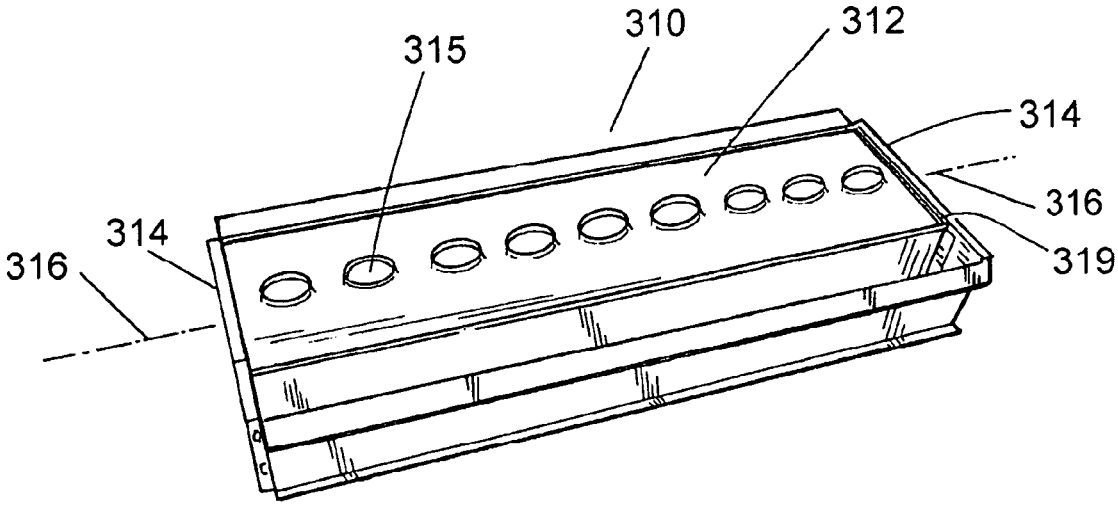
FIG. 5 is a photograph of the burner port drip shield of the present invention, in one embodiment.

FIG. 5 provides a perspective view of a burner port drip shield 300, in one embodiment of the present invention. The drip shield 310 is configured to intercept moisture that condenses along the walls of a vertically oriented heat exchanger and particularly the walls of heat exchanger tubes. A heat exchanger of a hot air furnace is shown in part at 12 in FIG. 9.

The drip shield 300 generally defines a plate 312 having a longitudinal axis 316. A plurality of through-openings 315 are placed in the plate 312 and preferably extend parallel to or along its longitudinal axis 316. The through-openings 315 are spaced apart so as to be positioned between and aligned with burner ports and respective heat exchanger tube inlets of a heat exchanger.

Figure 6:
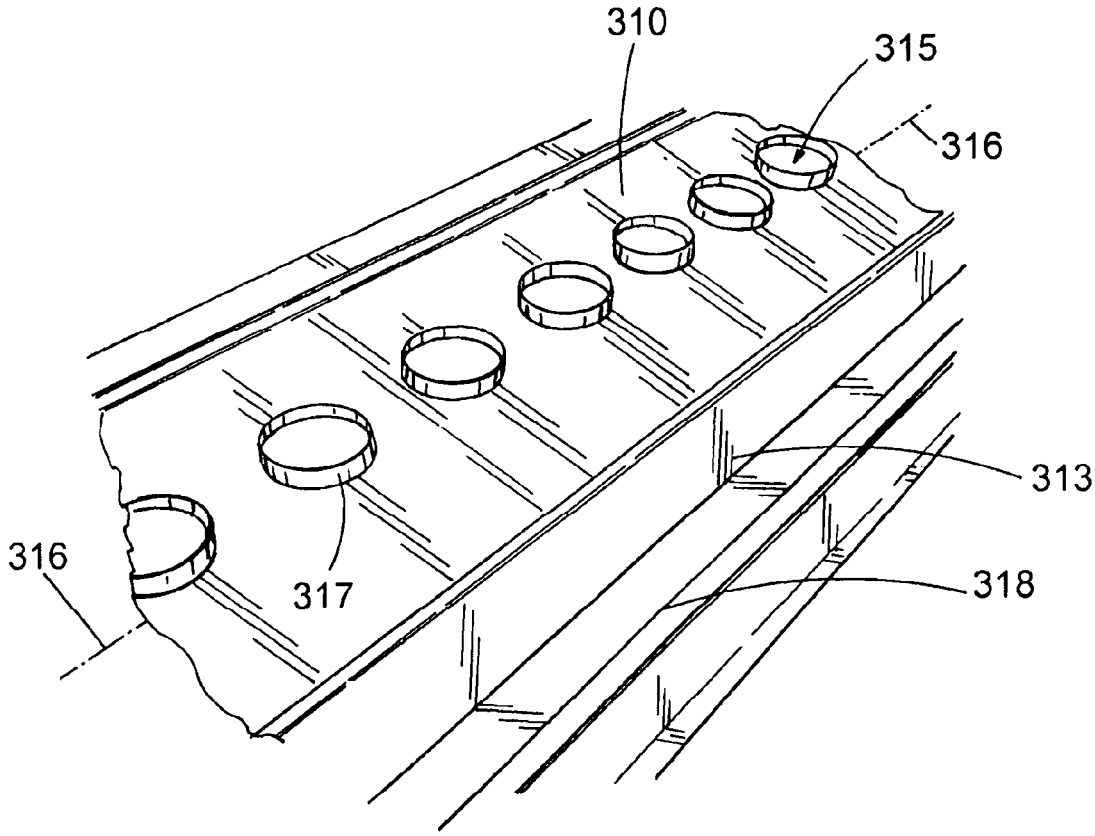
FIG. 6 is a photograph of an enlarged view of the drip shield of FIG. 5.

FIG. 6 is an enlarged view of the drip shield 300 of FIG. 5. The extruded through-openings 315 are more visible in this view. In this arrangement, the plurality of through-openings 315 extend parallel to longitudinal axis 316 of the drip shield 10. Each through-opening 315 has an inner diameter and each through-opening 315 will also preferably have a collar 17 there-around as shown in FIG. 6. Collar 317 defines an outer diameter of through-opening 315 that extends upward from the drip shield 310. Collars 317 help prevent condensates from dripping down through the openings 315 and onto the burner ports and also provide for laminar flow.

The drip shield 310 of FIGS. 5 and 6 has two opposing sides 313. One or more sides 312 include a channel 18 that catches condensate after it drips onto the shield 310. In addition, the drip shield 310 has two opposing ends 314. Each end 14 would generally include a shoulder 319 that facilitates the flow of condensation into channel 318 by preventing runoff from the ends 314.

In one preferred embodiment, the top perforated surface of drip shield 310 is sloped or peaks adjacent one side 313 to cause condensate to flow towards collection trough 318 along an opposite side 313. An alternate profile is to have a peak closer to the mid-region of shield 310 that runs along or parallel to the longitudinal axis 316 thereby causing condensate to flow towards both sides 313 and into multiple channels 318. Still another configuration is for drip shield 310 to have a peaked profile that is non-linear such as one which zigzags or curves as it extends along longitudinal axis 316. Of course, other configurations are also conceivable which will enable drip shield 310 to shed condensate.

Figure 9:
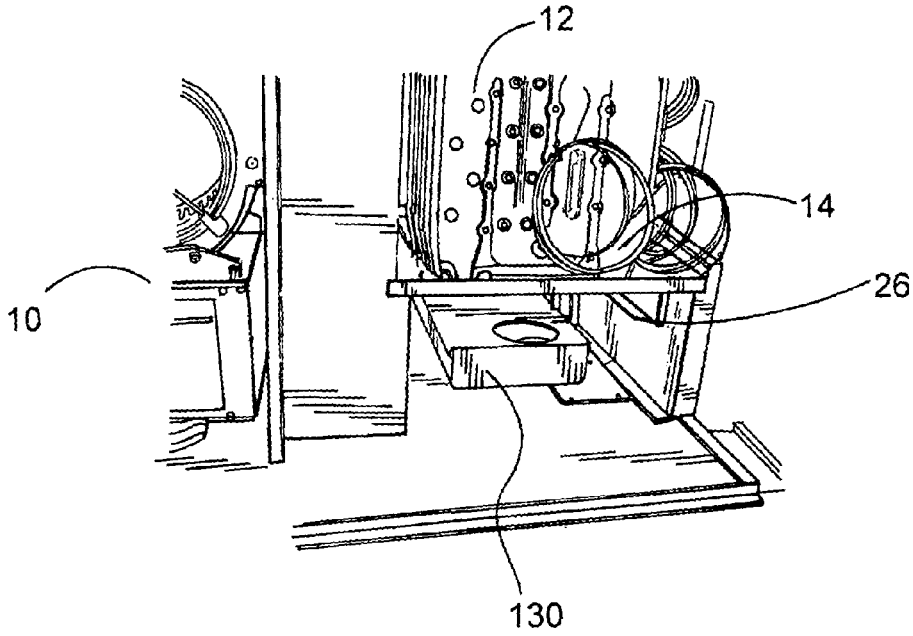
FIG. 9 is a photograph of a perspective view of a portion of a hot air furnace.

As noted, the through-openings 315 are spaced apart so as to be positioned between and aligned with burner ports and respective heat exchanger tube inlets of a heat exchanger 110 (FIG. 3). FIG. 9 provides a perspective view of a portion of a hot air furnace 10. Visible in this view is heat exchanger 12 that includes a plurality of adjacent heat exchanger tubes 14. Each heat exchanger tube 14 has an inlet for receiving air, air/fuel-gas mixture and partially combusted fuel-gas. The inlets are shown in FIG. 7 and are positioned below the heat exchanger tubes.

Figure 7:
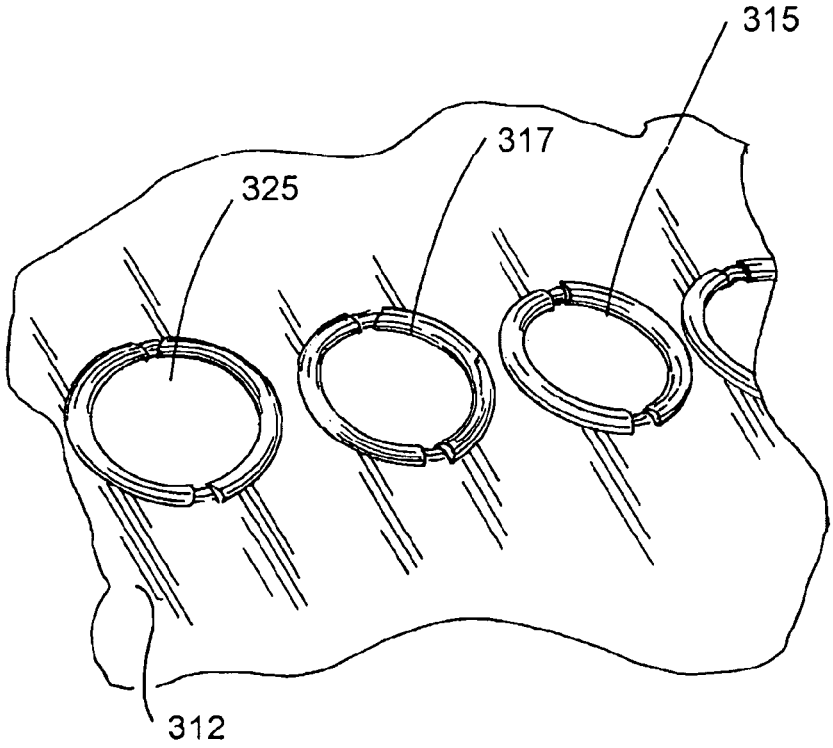
FIG. 7 is a photograph of the header panel as would be positioned below the heat exchanger tubes of a hot-air heat exchanger.

FIG. 7 provides a view of a header plate 312 below the heat exchanger tubes of a hot air furnace. A plurality of inlet openings 325 are seen. The outer diameters of the collars 317 of the through-openings 315 are slightly smaller than the diameters of the heat exchanger inlet openings 325. This arrangement blocks fluid communication between the burner port and the inlet opening 325 because droplets that form along the heat exchanger tube walls will fall from around the perimeter of the heat exchanger inlet opening 325 and upon drip shield 300. These condensate droplets will fall upon drip shield 300 radially outboard of collars 317 surrounding through-openings 315. Collars 317 prevent the condensate from entering through openings 315 and the angled or curved profile of drip shield 310 causes this condensate to move towards collection trough 318.

Referring again to FIG. 9, the furnace 10 also includes a gas combustion chamber 26. In this chamber, air and gas are brought in and mixed. The product of fuel-gas combustion and excess air are captured in the flue gas collector box 130 after circulating through the respective tubes 124. Finally, the drip shield 310 has been installed in the heat exchanger 12 and is at least partially visible.

Figure 8:
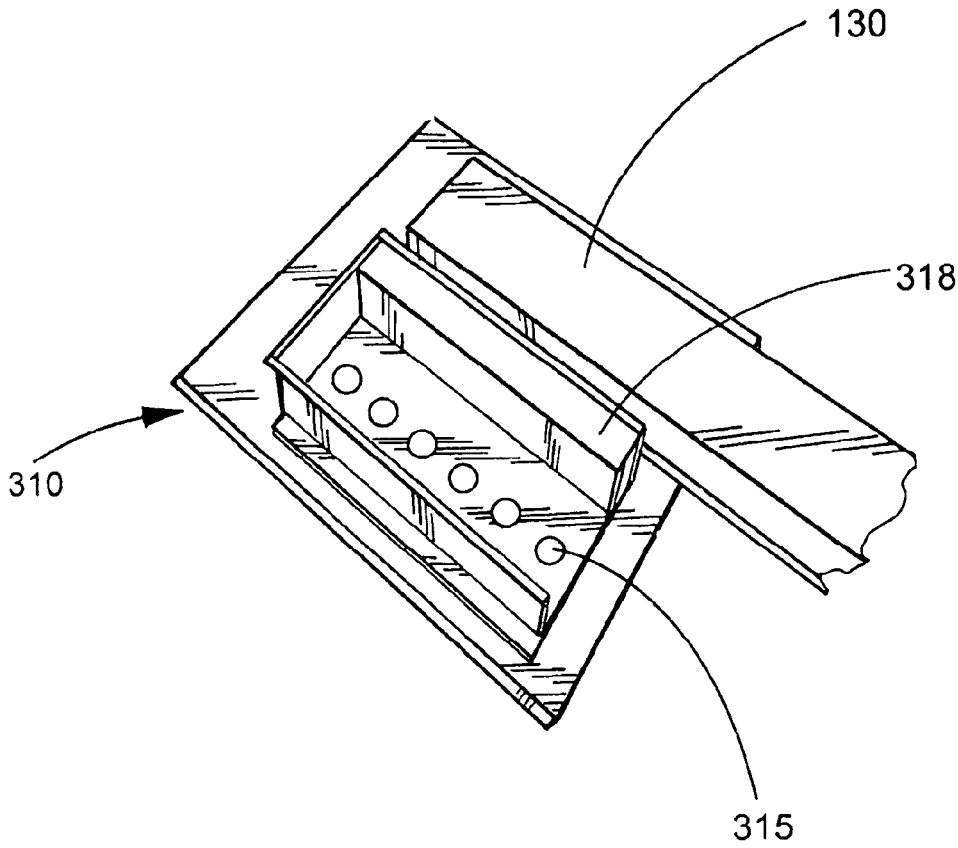
FIG. 8 is a photograph of the drip shield of FIG. 5.

FIG. 8 is a bottom view of the drip shield 300 of FIG. 5. Here, the drip shield 310 has been mounted under the heat exchanger. Gas collection box 130, channel 18 and through-openings 15 are readily visible therein.

Figure 10:
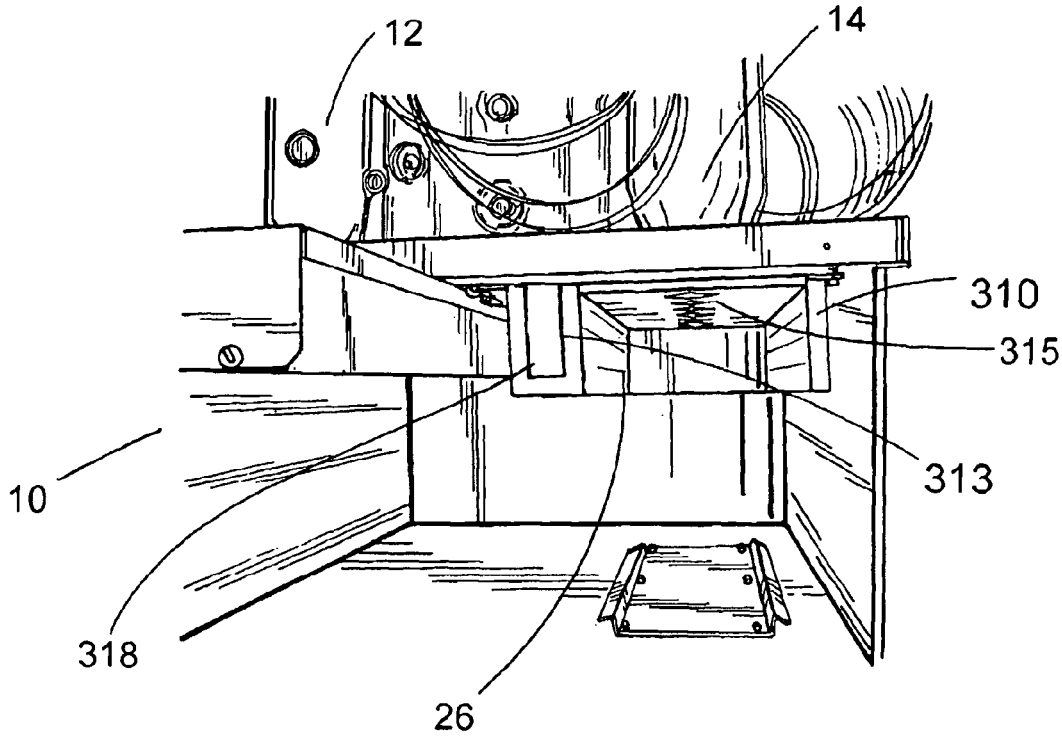
FIG. 10 is a photograph of an enlarged view of the hot air furnace of FIG. 9.

FIGS. 9 and 10 show the hot air furnace 10. In this Figure, a lower portion of the heat exchanger tube 14 of the heat exchanger 12 is seen. No burners have been installed into the furnace 10 but the drip shield 310 is installed below the heat exchanger. Through-openings 315 are visible, as is a collection trough 318. The condensate collection trough 318 is positioned adjacent to a side 313 of the drip shield 310. It is understood that a drain port may be provided to drain away collected condensates from the trough 318.

Figure 11:
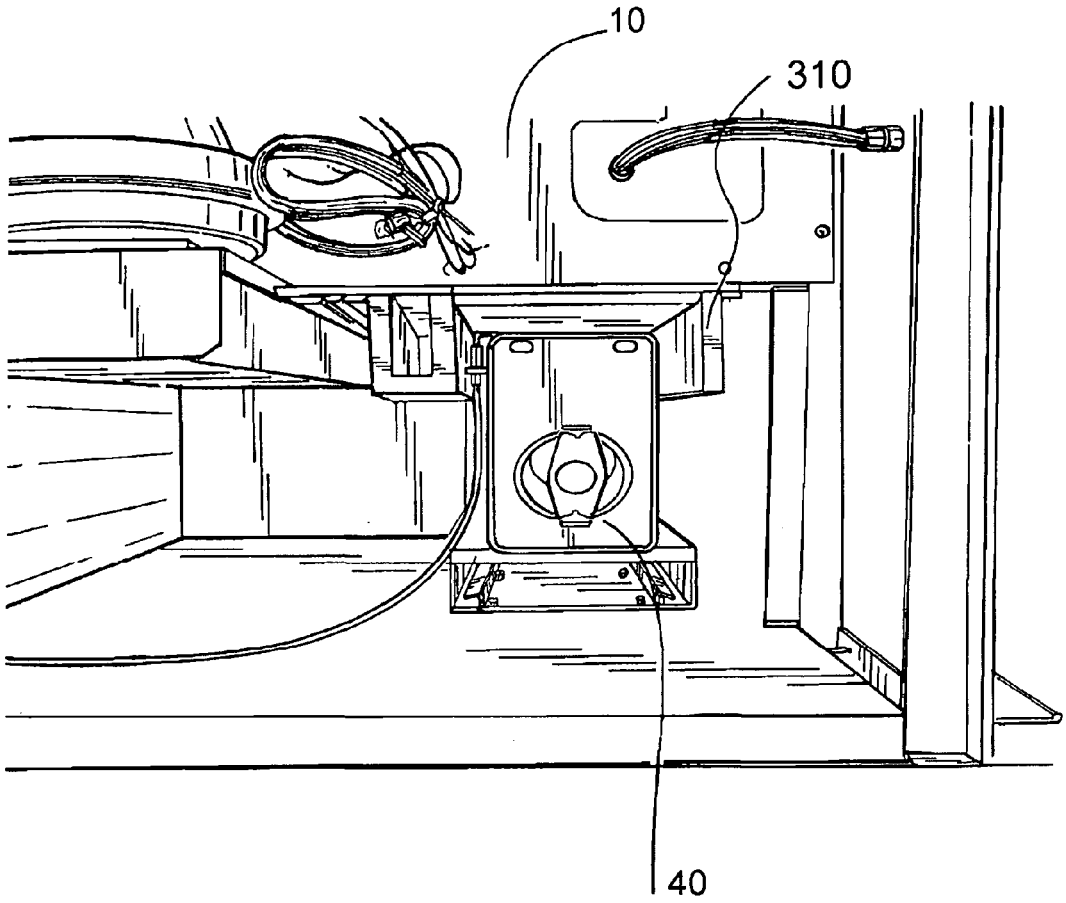
FIG. 11 is a photograph of a side view of the hot air furnace of FIG. 10.

FIG. 11 provides a side view of the hot air furnace 10 of FIG. 9. Here, a burner assembly 40 has been installed below the burner port drip shield 310.

Figure 12:
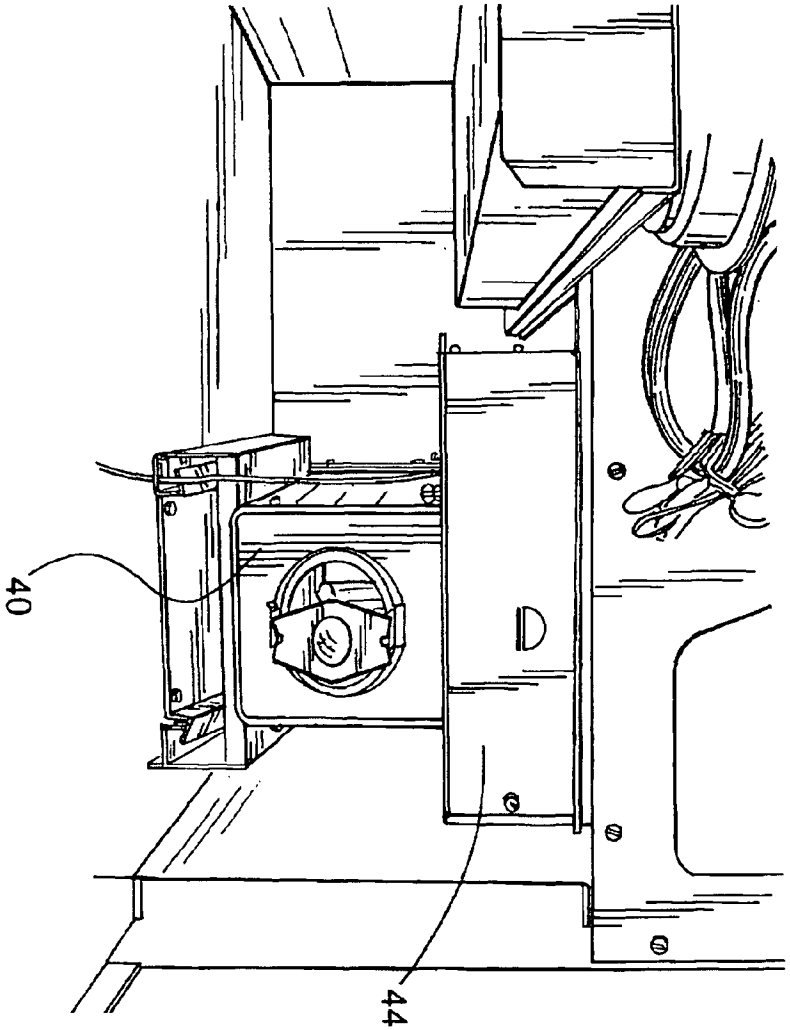
FIG. 12 demonstrates the hot air furnace of FIG. 11.

FIG. 12 demonstrates the hot air furnace 10 of FIG. 10. A secondary air end shield 44 has been added to complete the burner/heat exchanger assembly.

Figure 13:
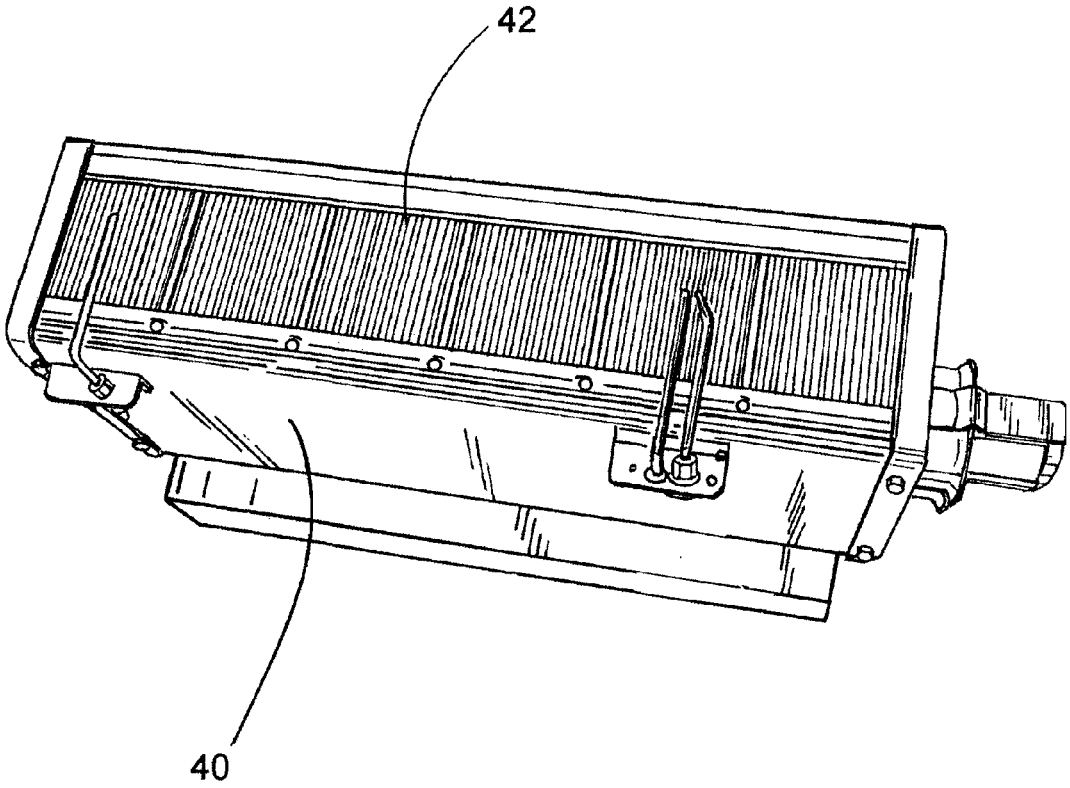
FIG. 13 is a photograph of a top view of a burner assembly.
Figure 14:
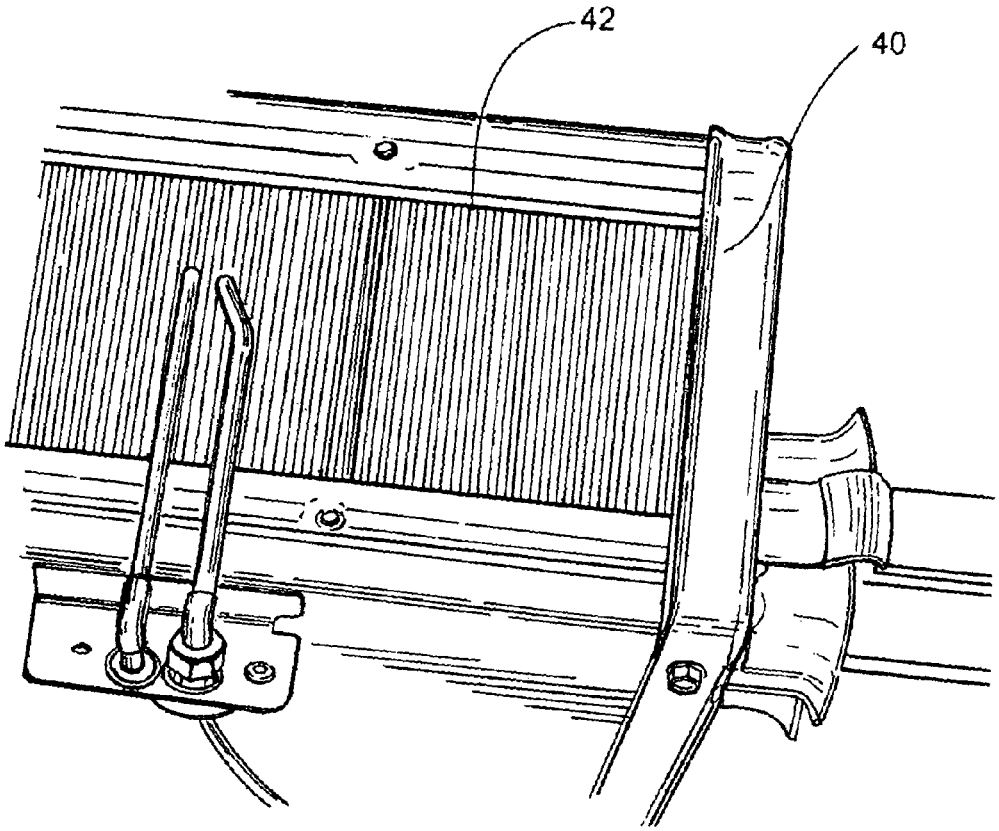
FIG. 14 is a photograph of an enlarged view of the burner assembly of FIG. 13.

FIG. 13 provides a top view of a burner assembly 40. A plurality of fins, or "burner ribbons" 42, are seen on top of the burner assembly 40. FIG. 14 presents an enlarged view of the burner assembly 40 of FIG. 13. The burner ribbons 42 are more clearly seen.

Thus, the present invention provides a drip shield for protecting burner ports of a burner assembly from moisture. It has been observed that during condensation, at least some of the moisture droplets will accumulate and flow down a vertically oriented heat exchanger. The use of a drip shield serves to collect the droplets and prevents the droplets from falling onto the burner faces.

Various changes to the foregoing described and shown structures would now be evident to those skilled in the art. Accordingly, the particularly disclosed scope of the invention is set forth in the following claims.

What is claimed is:

1. A drip shield for intercepting condensates that form along interior walls of a vertically-oriented heat exchanger, comprising:

a plate having a longitudinal axis and having a peaked profile extending along the plate; a plurality of through-openings placed in the plate, the through-openings being spaced apart so as to be positioned in alignment with burner ports and within inlets of the heat exchanger, each of the plurality of through-openings having a collar extending upward from the plate, each collar having an outer diameter that is smaller than the inner diameter of its corresponding heat exchanger inlet so as to extend into said inlet for accommodating said condensates formed along the interior thereof; and said plate extending from each of said through-openings to at least one channel running alongside of the plate for receiving said condensates that runs off of the peaked profile of the plate.

2. The drip shield of claim 1, wherein the drip shield further comprises:

opposing ends; and a shoulder positioned along each of the opposing ends for further diverting condensate toward the channel.

3. A drip shield of claim 1 wherein said collar is:

defined by an upwardly curved annular ring which is spaced from and extends into said inlet of said heat exchanger;

said curved annular ring causing less turbulent laminar flow of secondary combustion air entering said heat exchanger inlet.

4. A shield of claim 3 wherein said heat exchanger is a clam-shell heat exchanger.

5. A shield of claim 3 wherein said heat exchanger is a tubular heat exchanger.

* * * * *